US011707824B2

(12) United States Patent
Chien

(10) Patent No.: US 11,707,824 B2
(45) Date of Patent: Jul. 25, 2023

(54) METHOD FOR FEEDING NAILS IN A NAIL GUN AND NAIL GUN IMPLEMENTING THE SAME

(71) Applicant: BASSO INDUSTRY CORP., Taichung (TW)

(72) Inventor: Chia-Yu Chien, Taichung (TW)

(73) Assignee: Basso Industry Corp., Taichung (TW)

( * ) Notice: Subject to any disclaimer, the term of this patent is extended or adjusted under 35 U.S.C. 154(b) by 156 days.

(21) Appl. No.: 17/393,766

(22) Filed: Aug. 4, 2021

(65) Prior Publication Data

US 2022/0040836 A1 Feb. 10, 2022

(30) Foreign Application Priority Data

Aug. 5, 2020 (TW) ..... 109126541

(51) Int. Cl.
*B25C 1/06* (2006.01)
*B25C 5/15* (2006.01)
*B25C 1/00* (2006.01)

(52) U.S. Cl.
CPC ..... *B25C 1/005* (2013.01); *B25C 1/06* (2013.01)

(58) Field of Classification Search
CPC .. B25C 1/06; B25C 5/15; B25C 1/047; B25C 5/1627
See application file for complete search history.

(56) References Cited

U.S. PATENT DOCUMENTS 4,323,127 A * 4/1982 Cunningham ..... B25C 1/06 124/78
4,928,868 A * 5/1990 Kerrigan ..... B25C 1/06 173/13
5,098,004 A * 3/1992 Kerrigan ..... B25C 5/15 173/121
8,276,798 B2 10/2012 Moeller et al.
8,387,718 B2 3/2013 Leimbach et al.
2002/0108994 A1* 8/2002 Burke ..... B25C 1/06 227/81
2008/0073405 A1* 3/2008 Shima ..... B25C 1/06 227/129
2009/0095787 A1* 4/2009 Liang ..... B25C 1/06 227/131
2010/0038394 A1* 2/2010 Hlinka ..... B25C 1/06 227/8

(Continued)

FOREIGN PATENT DOCUMENTS

TW 352619 U 2/1999

*Primary Examiner* — Praachi M Pathak
(74) *Attorney, Agent, or Firm* — Burris Law, PLLC

(57) ABSTRACT

A nail gun includes a gun body, a muzzle unit, a nail-feeding unit, a nail-striking unit, and a control unit for controlling the nail-feeding unit and the nail-striking unit to implement a method for feeding nails. The method includes the following steps: energizing a nail-striking solenoid valve of the nail-striking unit to perform a nail-striking operation on one of the nails; de-energizing the nail-striking solenoid valve, and simultaneously starting to count a predetermined delay time period in idle; and upon elapse of the predetermined delay time period, energizing a nail-feeding solenoid valve of the nail-feeding unit to perform a nail-feeding operation on another one of the nails.

10 Claims, 12 Drawing Sheets

(56) References Cited

U.S. PATENT DOCUMENTS

| | | | | |
|---|---|---|---|---|
| 2010/0038395 | A1* | 2/2010 | Krondorfer | B25C 1/06 227/8 |
| 2010/0038396 | A1* | 2/2010 | Krondorfer | B25C 1/06 227/8 |
| 2010/0237124 | A1* | 9/2010 | Shima | B25C 1/06 227/129 |

* cited by examiner

METHOD FOR FEEDING NAILS IN A NAIL GUN AND NAIL GUN IMPLEMENTING THE SAME

CROSS-REFERENCE TO RELATED APPLICATION

This application claims priority of Taiwanese Patent Application No. 109126541, filed on Aug. 5, 2020.

FIELD

The disclosure relates to a nail gun, and more particularly to a method for feeding nails in a nail gun, and a nail gun implementing the same.

BACKGROUND

Referring to FIG. 1, a conventional nail gun 1 disclosed in Taiwanese Patent No. 352619 is adapted for use with a plurality of nails 10. The nail gun 1 includes a muzzle member 11, a pushing rod 12, a striking pin 13 and a piston 14.

The muzzle member 11 is adapted to receive one of the nails 10 pushed by the pushing rod 12. The striking pin 13 is adapted to strike the one of the nails 10 out of the nail gun 1. The piston 14 is configured to be driven by air pressure to drive movement of the pushing rod 12. After the striking pin 13 strikes the one of the nails 10 and starts moving away from the muzzle member 11, the piston 14 moves toward the muzzle member 11 at a relatively slow speed and drives the pushing rod 12 to push another one of the nails 10' into the muzzle member 11. As such, the striking pin 13 that is moving away from the muzzle member 11 does not interfere with the nail 10' that is entering the muzzle member 11.

However, although the moving speed of the piston 14 toward the muzzle member 11 is relatively slow, the nail 10' entering the muzzle member 11 is at risk of interfering with movement of the striking pin 13 since the nail 10' is disposed proximate to the muzzle member 11. As a result, the nail 10' entering the muzzle member 11 may become skewed, and the following nail-striking process may be affected, thereby leading to malfunction of the nail gun.

In another conventional nail gun disclosed in U.S. Pat. No. 8,276,798B2, the nail-feeding structure is configured to move in the opposite direction (i.e., away from the muzzle member) during the nail-striking process, therefore eliminating the above-mentioned interference problem. However, such configuration keeps the nail-feeding structure at a position far away from the muzzle member for a longer period of time, and may result in higher power consumption.

SUMMARY

Therefore, the object of the disclosure is to provide a method for feeding nails in a nail gun, and a nail gun implementing the same that can alleviate at least one of the drawbacks of the prior art.

According to one aspect of the disclosure, a method for feeding nails in a nail gun is disclosed. The nail gun includes a gun body, a muzzle unit, a nail-feeding unit, a nail-striking unit and a control unit.

The muzzle unit is connected to the gun body. The nail-feeding unit is connected to the muzzle unit, is used for loading the nails, and includes a pushing member that is configured to perform a nail-feeding operation which feeds one of the nails to the muzzle unit, and a nail-feeding solenoid valve that is configured to drive the pushing member to perform the nail-feeding operation when being electrically energized. The nail-striking unit is mounted in the gun body, is configured to perform a nail-striking operation which strikes the one of the nails out of the muzzle unit, and includes a nail-striking solenoid valve that is configured to drive the nail-striking unit to perform the nail-striking operation when being electrically energized. The control unit is mounted in the gun body, and is electrically connected to the nail-feeding solenoid valve and the nail-striking solenoid valve for controlling the nail-feeding unit and the nail-striking unit to implement the method.

The method includes the following steps: energizing the nail-striking solenoid valve of the nail-striking unit to perform the nail-striking operation on the one of the nails; de-energizing the nail-striking solenoid valve of the nail-striking unit, and simultaneously starting to count a predetermined delay time period in idle; and upon elapse of the delay time period, energizing the nail-feeding solenoid valve of the nail-feeding unit to drive the pushing member to perform the nail-feeding operation on another one of the nails.

According to another aspect of the disclosure, a nail gun includes a gun body, a muzzle unit, a nail-feeding unit, a nail-striking unit and a control unit.

The muzzle unit is connected to the gun body, and has a muzzle mouth. The nail-feeding unit is connected to the muzzle unit, is adapted for loading a plurality of nails, and includes a pushing member and a nail-feeding solenoid valve. The pushing member is configured to perform a nail-feeding operation which feeds one of the nails to the muzzle unit, and in which the pushing member is movable relative to the muzzle unit between a nail-engaging position that is distal from the muzzle unit, and a nail-releasing position that is proximate to the muzzle unit. The nail-feeding solenoid valve is configured to drive the pushing member to perform the nail-feeding operation when being electrically energized. The nail-striking unit is mounted in the gun body, and includes an impact member and a nail-striking solenoid valve. The impact member is configured to perform a nail-striking operation which strikes the one of the nails out of the muzzle mouth of the muzzle unit, and in which the impact member is movable relative to the muzzle mouth from a nail-striking starting position that is distal from the muzzle mouth, to a nail-striking finishing position that is proximate to the muzzle mouth. The nail-striking solenoid valve is configured to drive the impact member to perform the nail-striking operation when being electrically energized. The control unit is mounted in the gun body, and is electrically connected to the nail-feeding solenoid valve and the nail-striking solenoid valve for controlling the nail-feeding unit and the nail-striking unit, such that the nail-striking operation and the nail-feeding operation are separated by a predetermined delay time period.

The control unit is configured for: energizing the nail-striking solenoid valve of the nail-striking unit to perform the nail-striking operation; de-energizing the nail-striking solenoid valve of the nail-striking unit, and simultaneously starting to count the predetermined delay time period in idle; and upon elapse of the predetermined delay time period, energizing the nail-feeding solenoid valve of the nail-feeding unit to perform the nail-feeding operation.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
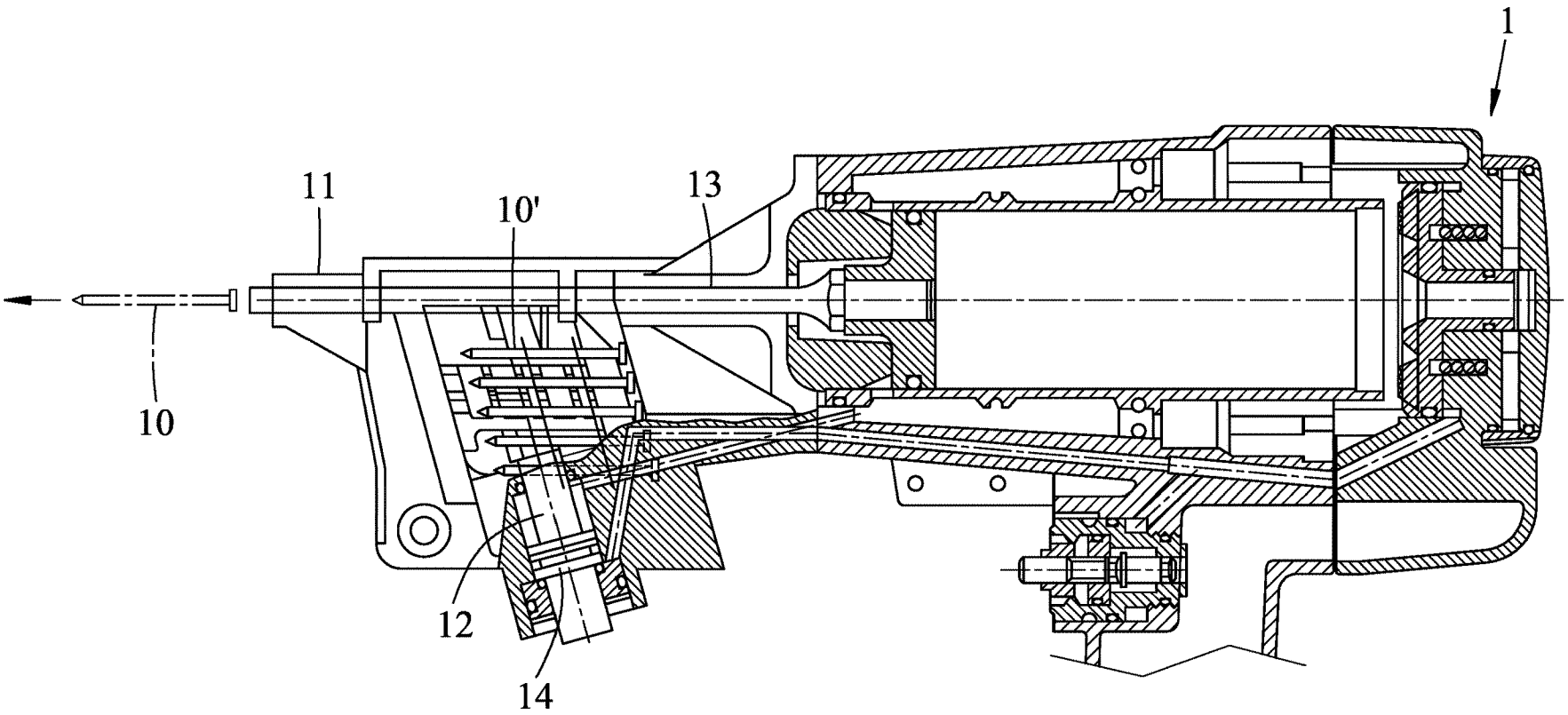
FIG.1 PRIOR ART
FIG. 1 is a cross-sectional view of a conventional nail gun disclosed in Taiwanese Patent No. 352619.
Figure 2:
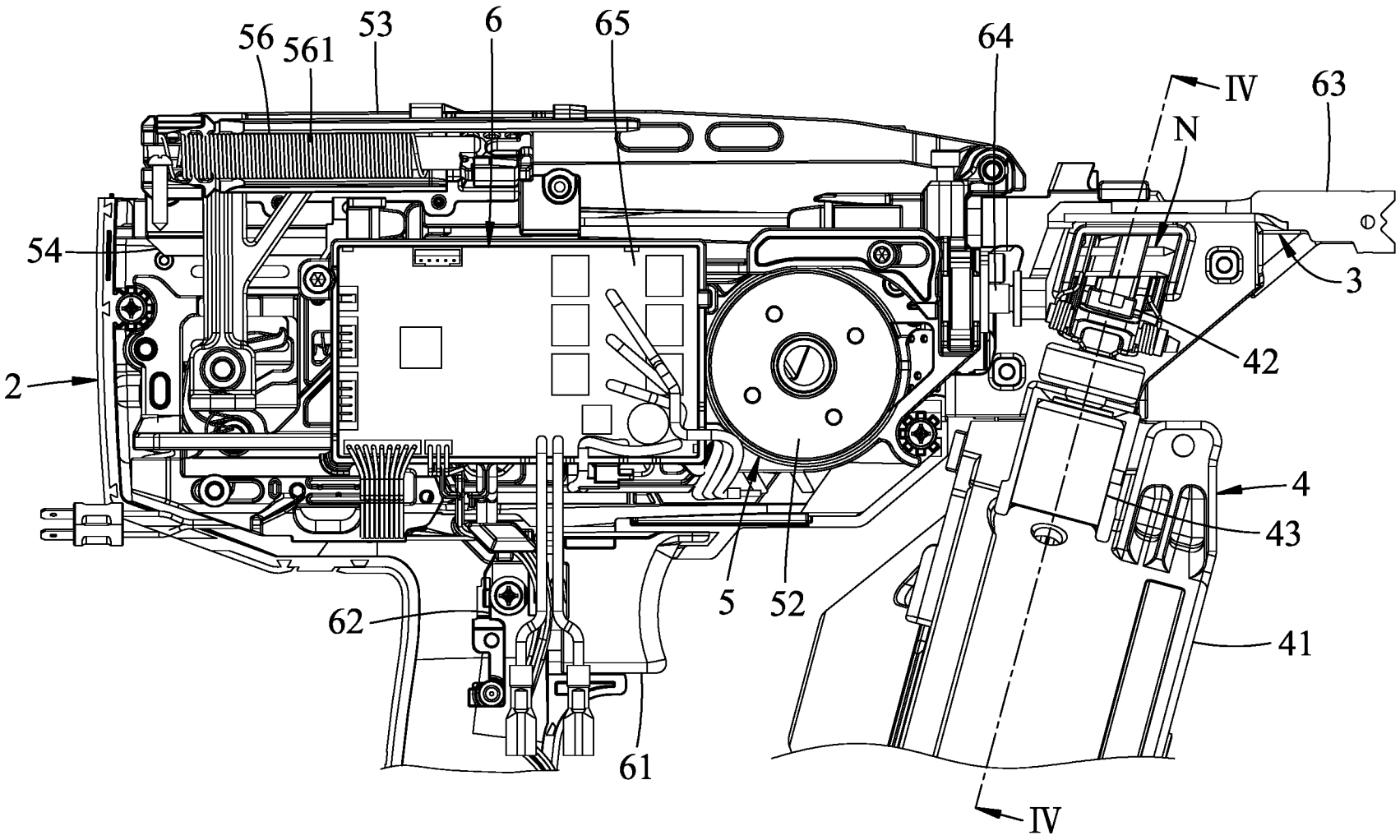
FIG. 2 is a fragmentary side view of an embodiment of a nail gun according to the disclosure.
Figure 3:
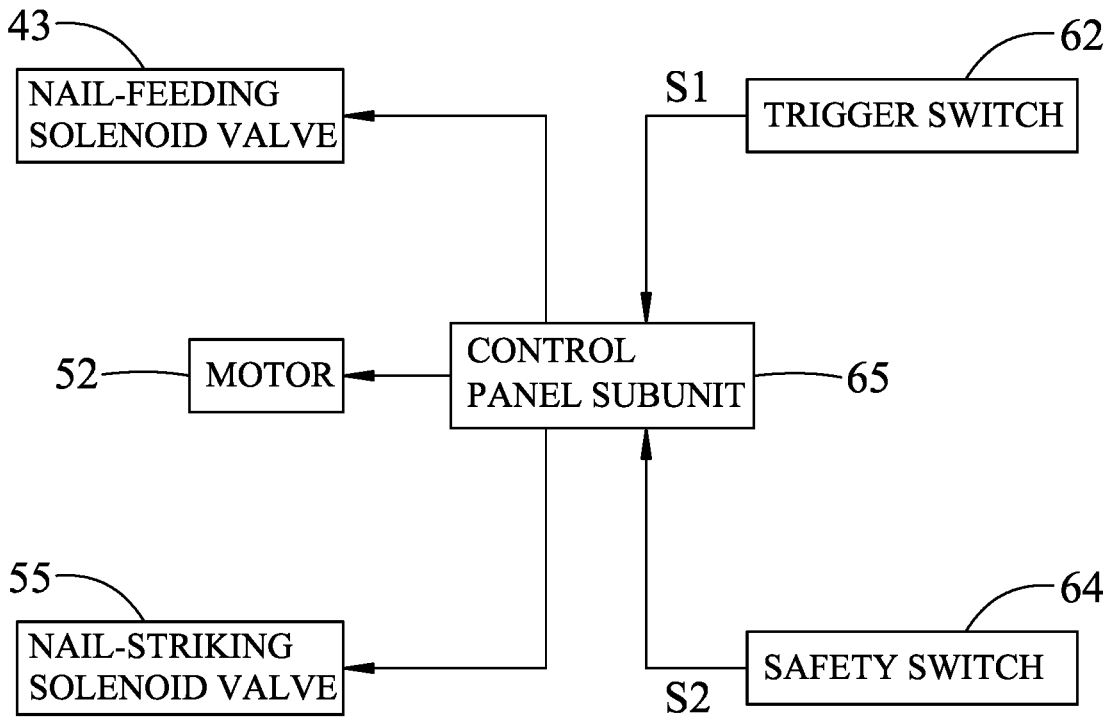
FIG. 3 is a circuit block diagram of the embodiment.
Figure 4:
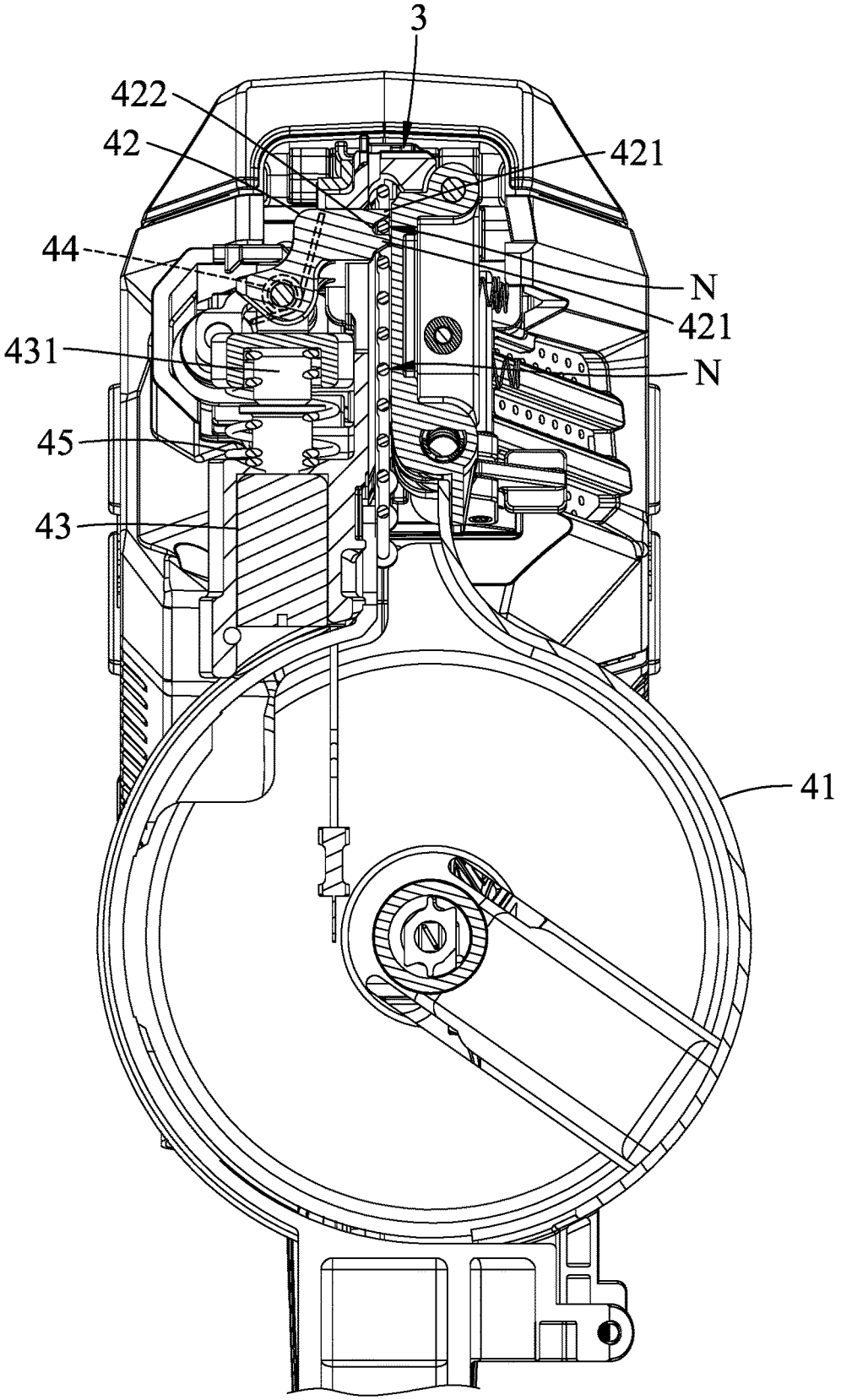
FIG. 4 is a cross-sectional view taken along line IV-IV of FIG. 2, illustrating a pushing member of the embodiment at a nail-releasing position.

Referring to FIGS. 2, 3 and 4, an embodiment of a nail gun according to the disclosure is adapted for use with a plurality of nails (N). The nail gun includes a gun body 2, a muzzle unit 3, a nail-feeding unit 4, a nail-striking unit 5 and a control unit 6.

Figure 6:
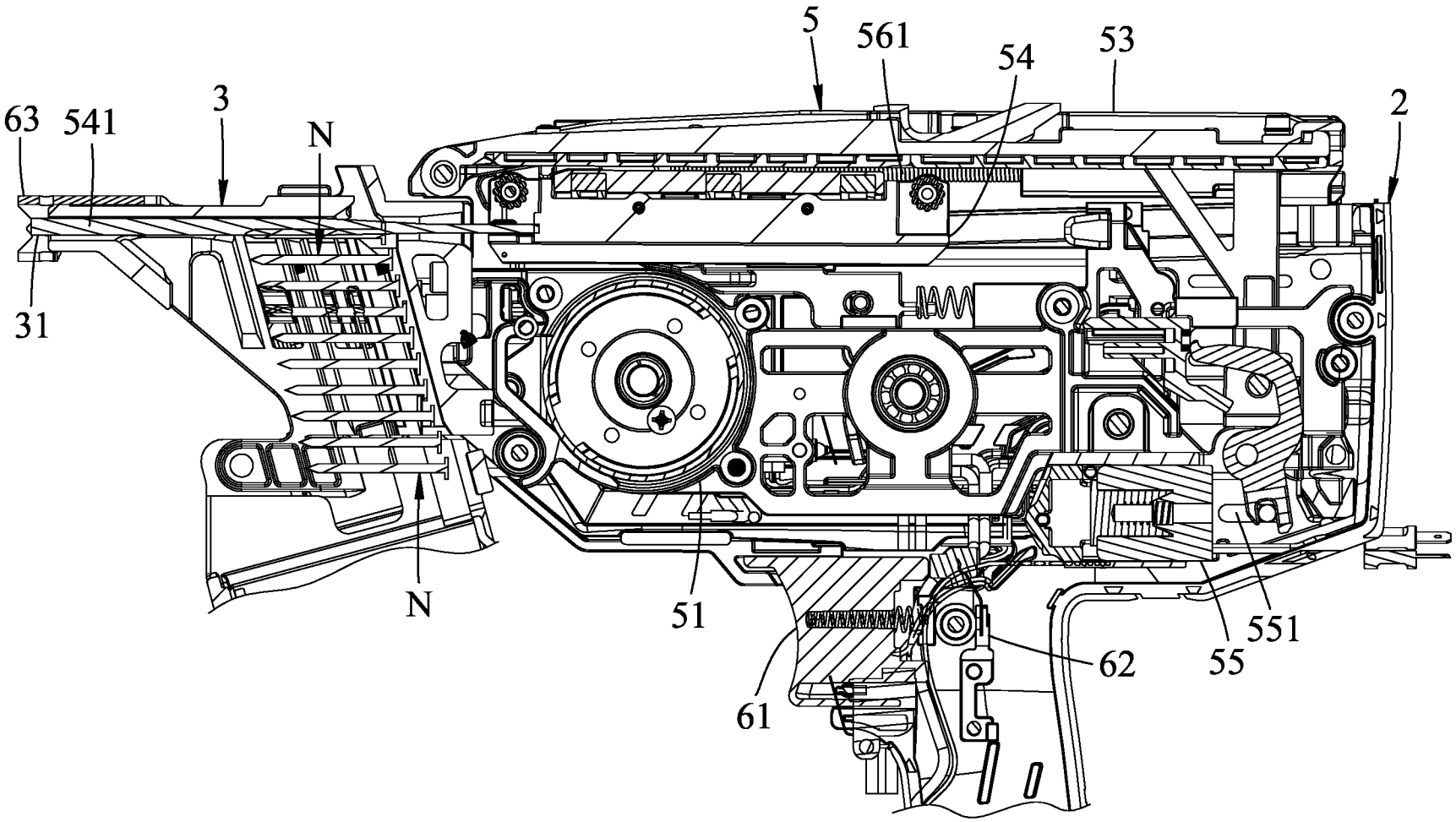
FIG. 6 is a fragmentary cross-sectional view of the embodiment.

The muzzle unit 3 is connected to a front end of the gun body 2, and has a muzzle mouth 31 that is adapted for each of the nails (N) to exit the nail gun (see FIG. 6).

The nail-feeding unit 4 is connected to the muzzle unit 3, and includes a magazine 41, a pushing member 42, a nail-feeding solenoid valve 43, a torsion spring 44 and a return spring 45.

The magazine 41 is connected to the muzzle unit 3, and is adapted for loading the nails (N) in a row. It should be noted that, in the present embodiment, the magazine 41 is configured for loading the nails (N) that are arranged in a row which forms a roll. However, in variations of the embodiment, the magazine 41 may be configured for loading nails (N) that are arranged in a straight line.

Figure 5:
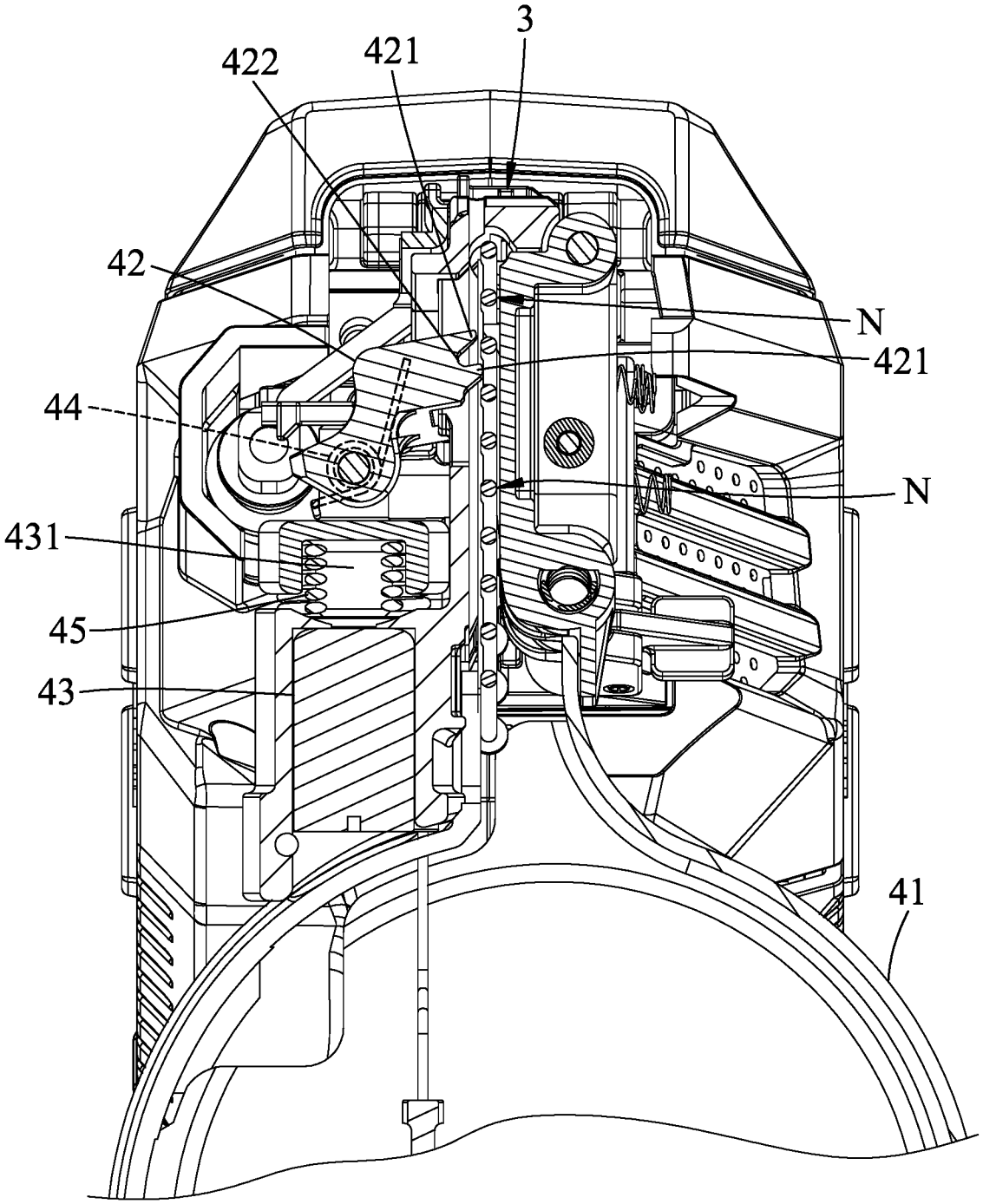
FIG. 5 is a cross-sectional view similar to FIG. 4, illustrating the pushing member of the embodiment at a nail-engaging position.

Referring to FIGS. 4 and 5, the pushing member 42 is configured to perform a nail-feeding operation which feeds one of the nails (N) to the muzzle unit 3, and in which the pushing member 42 is movable relative to the muzzle unit 3 between a nail-engaging position (FIG. 5) and a nail-releasing position (FIGS. 2 and 4). When at the nail-engaging position, the pushing member 42 is distal from the muzzle unit 3, and when at the nail-releasing position, the pushing member 42 is proximate to the muzzle unit 3. It should be noted that, in the present embodiment, the pushing member 42 has two ridge portions 421 that define a receiving groove 422 therebetween. During the nail-feeding operation, the one of the nails (N) is to be engaged with the receiving groove 422.

The nail-feeding solenoid valve 43 is configured to drive the pushing member 42 to perform the nail-feeding operation when being electrically energized. Specifically, the nail-feeding solenoid valve 43 has a telescopic nail-feeding valve rod 431 that is pivotally connected to the pushing member 42, and that is changeable in length for driving movement of the pushing member 42.

The torsion spring 44 is disposed between and abutting against the nail-feeding solenoid valve 43 and the pushing member 42, and is configured to bias the pushing member 42 to pivot toward the straight line of the nails (N).

The return spring 45 is mounted to the nail-feeding solenoid valve 43, and is configured to bias the nail-feeding valve rod 431 of the nail-feeding solenoid valve 43 to move toward the muzzle unit 3 to move the pushing member 42 toward the nail-releasing position when the nail-feeding solenoid valve 43 is de-energized.

When the nail-feeding solenoid valve 43 is energized, an electromagnetic force is generated to drive the nail-feeding valve rod 431 to move away from the muzzle unit 3 to thereby move the pushing member 42 toward the nail-engaging position. When the nail-feeding solenoid valve 43 is de-energized, the electromagnetic force vanishes such that the return spring 45 is allowed to drive the nail-feeding valve rod 431 to move and to cooperate with biasing force of torsion spring 44 to thereby move the pushing member 42 toward the nail-releasing position.

Referring to FIGS. 2, 3 and 6, the nail-striking unit 5 is mounted in the gun body 2, and includes a flywheel 51, a motor 52, a swing arm 53, an impact member 54, a nail-striking solenoid valve 55 and a retrieving subunit 56.

The flywheel 51 is rotatably mounted to the gun body 2. The motor 52 drives rotation of the flywheel 51 by electric power. The swing arm 53 is pivotally mounted to the gun body 2, and is pivotable to become proximate to or distal from the flywheel 51.

The impact member 54 is slidably mounted to the swing arm 53, is disposed between the swing arm 53 and the flywheel 51, and has a striking pin 541 that extends in the muzzle unit 3. The impact member 54 is configured to perform a nail-striking operation which strikes the one of the nails (N) out of the muzzle mouth 31 of the muzzle unit 3, and in which the impact member 54 is movable relative to the muzzle mouth 31 from a nail-striking starting position (FIG. 2) to a nail-striking finishing position (FIG. 6). When at the nail-striking starting position, the impact member 54 is distal from the muzzle mouth 31. When at the nail-striking finishing position, the impact member 54 is proximate to the muzzle mouth 31.

The nail-striking solenoid valve 55 is configured to drive the impact member 54 to perform the nail-striking operation when being electrically energized, and has a nail-striking valve rod 551 that is movable to contact the swing arm 53 to drive pivotal movement of the swing arm 53.

The retrieving subunit 56 includes two resilient members 561 that are mounted between the gun body 2 and the impact member 54, and that are configured to bias the impact member 54 toward the nail-striking starting position.

When the nail-striking solenoid valve 55 is energized, an electromagnetic force is generated to move the nail-striking valve rod 551 in the gun body 2 so as to move the swing arm 53 and the impact member 54 toward the flywheel 51, and then once the impact member 54 contacts the flywheel 51, the impact member 54 is driven by the rotation of the flywheel 51 to move from the nail-striking starting position toward the nail-striking finishing position.

The control unit 6 is mounted in the gun body 2, is electrically connected to the nail-feeding solenoid valve 43 and the nail-striking solenoid valve 55, and is configured to energize the nail-feeding solenoid valve 43 and the nail-striking solenoid valve 55. Specifically, the control unit 6 includes a trigger subunit 61, a trigger switch 62, a safety subunit 63, a safety switch 64 and a control panel subunit 65.

The trigger subunit 61 is pivotally mounted to the gun body 2, and is manually operable. The trigger switch 62 is mounted to the gun body 2, and is configured to be activated by pivotal movement of the trigger subunit 61 to transmit a trigger signal (S1).

The safety subunit 63 is slidably mounted to the muzzle unit 3, and is manually operable. The safety switch 64 is mounted to the gun body 2, and is configured to be activated by sliding movement of the safety subunit 63 to transmit a safety signal (S2).

The control panel subunit 65 is electrically communicatively connected to the trigger switch 62, the safety switch 64, the motor 52, the nail-feeding solenoid valve 43 and the nail-striking solenoid valve 55, and is configured to drive the motor 52 to rotate the flywheel 51 to a predetermined speed based on one of the trigger signal (S1) and the safety signal (S2), and then to energize the nail-striking solenoid valve 55 for a predetermined nail-striking time period to perform the nail-striking operation based on the other one of the trigger signal (S1) and the safety signal (S2).

The control panel subunit 65 is further configured to count a predetermined delay time period (T) in idle and, upon elapse of the delay time period (T), to energize the nail-feeding solenoid valve 43 for a predetermined nail-feeding time period to perform the nail-feeding operation.

Referring to FIGS. 4 and 5, the nail-feeding operation performed by the nail-feeding unit 4 is described as follows.

Once the nail-feeding solenoid valve 43 is energized by the control panel subunit 65, the nail-feeding valve rod 431 of the nail-feeding solenoid valve 43 drives the pushing member 42 to move from the nail-releasing position towards the nail-engaging position. During this movement, the pushing member 42 contacts a corresponding one of the nails (N) and is pushed thereby to pivot away from the straight line of the nails (N) against the biasing force of the torsion spring 44. Then, one of the ridge portions 421 of the pushing member 42 slides past the corresponding one of the nails (N), such that the receiving groove 422 of the pushing member 42 is engaged with the corresponding one of the nails (N). At the same time, the pushing member 42 reaches the nail-engaging position, and the control panel subunit 65 is actuated to de-energize the nail-feeding solenoid valve 43 to release the nail-feeding valve rod 431, so that the nail-feeding valve rod 431 is biased by the return spring 45 to return to the nail releasing position, thereby moving the corresponding one of the nails (N) into the muzzle unit 3.

Referring to FIGS. 2 and 6, the nail-striking operation performed by the nail-striking unit 5 is described as follows.

Once the nail-striking solenoid valve 55 is energized by the control panel subunit 65, the nail-striking valve rod 551 of the nail-striking solenoid valve 55 drives the swing arm 53 to pivot toward the flywheel 51, such that the impact member 54 is brought into contact with the flywheel 51 and is urged by the rotation of the flywheel 51 to move from the nail-striking starting position toward the nail-striking finishing position. When the impact member 54 reaches the nail-striking position and the striking pin 541 of the impact member 54 finishes striking the corresponding one of the nails (N) out of the muzzle unit 3, the control panel subunit 65 is actuated to de-energize the nail-striking solenoid valve 55.

It should be noted that the above-mentioned nail-feeding and nail-striking operations have been disclosed in the prior art of the field. Since they are not the main feature of the present disclosure and should be appreciated by those familiar with the art based on the description above, further details thereof will not be provided hereinafter.

Referring to FIGS. 3, 6, 7 and 8, a method for feeding the nails (N) in the nail gun according to the disclosure is implemented by the control unit 6 of the nail gun. The method includes the following steps.

Step 70: The control panel subunit 65 of the control unit 6 controls the nail-striking unit 5 to perform the nail-striking operation on one of the nails (N).

Step 80: The control panel subunit 65 de-energizes the nail-striking solenoid valve 55 of the nail-striking unit 5 after the nail-striking operation, and simultaneously starts to count a predetermined delay time period (T) in idle. In the present embodiment, the delay time period (T) ranges from 0.001 second to 1 second, preferably from 0.001 second to 0.01 second.

Step 90: Upon elapse of the delay time period (T), the control panel subunit 65 of the control unit 6 controls the nail-feeding unit 4 to perform the nail-feeding operation on another one of the nails (N).

Figure 7:
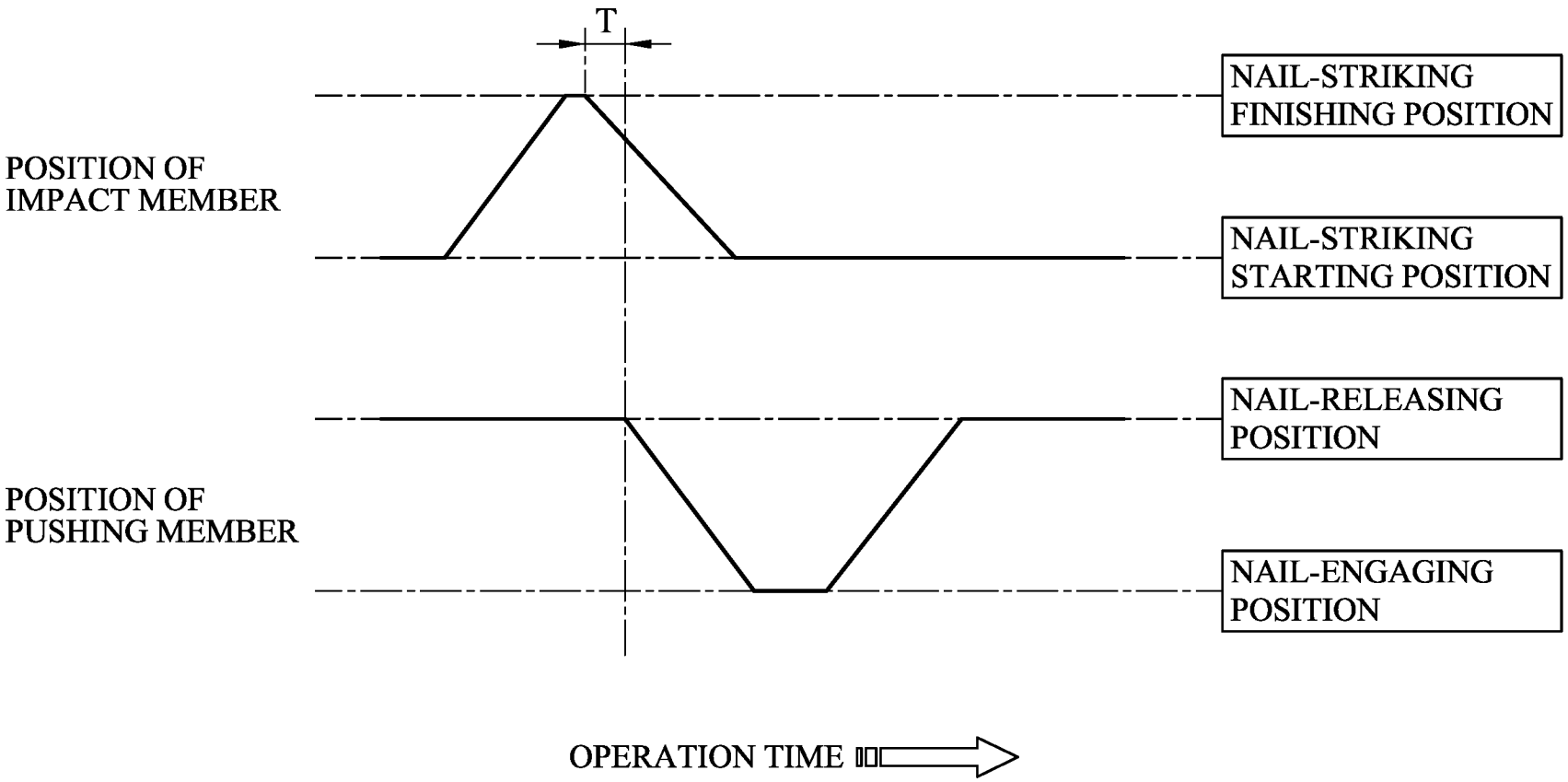
FIG. 7 is a schematic diagram illustrating an operational sequence of the embodiment.
Figure 8:
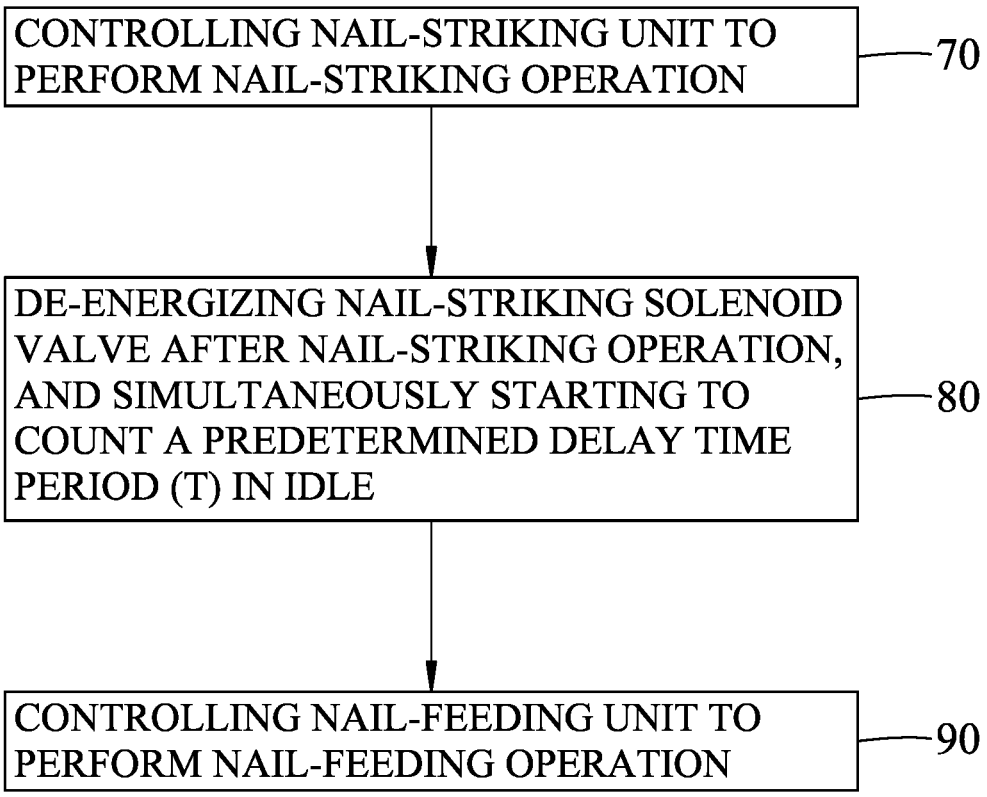
FIG. 8 is a flowchart illustrating a method for feeding nails in a nail gun implemented by the embodiment.

As shown in FIG. 7, the nail-striking operation and the nail-feeding operation are separated by the delay time period (T). That is, when the impact member 54 completes the nail-striking operation and is just about to leave the nail-striking finishing position, the control unit 6 does not immediately energize the nail-feeding solenoid valve 43 of the nail-feeding unit 4 to move the pushing member 42, but instead counts the delay time period (T) before energizing the nail-feeding solenoid valve 43. Therefore, when the impact member 54 is returning to the nail-striking starting position, the pushing member 42 is still moving toward or only arriving at the nail-engaging position, so that movement of the impact member 54 does not interfere with movement of the pushing member 42 or the corresponding one of the nails (N) engaged therewith.

Referring to FIGS. 3, 6, 9 and 10, when the safety subunit 63 is operated (i.e., moved toward the gun body 2) before the trigger subunit 61 is operated, the nail gun enters a single-firing mode. In this case, Step 70 further includes the following steps.

Step 71: The control panel subunit 65 receives the safety signal (S2) transmitted by the safety switch 64.

Step 72: The control panel subunit 65 controls the motor 52 to start rotating the flywheel 51.

Step 73: The control panel subunit 65 receives the trigger signal (S1) transmitted by the trigger switch 62.

Step 74: The control panel subunit 65 energizes the nail-striking solenoid valve 55 to start performing the nail-striking operation. During this time, the nail-striking solenoid valve 55 constantly generates an electromagnetic force that drives the nail-striking valve rod 551 to move the swing arm 53 toward the flywheel 51. When the impact member 54 contacts the flywheel 51, it is driven by the rotation of the flywheel 51 to move from the nail-striking starting position to the nail-striking finishing position, causing the striking pin 541 to strike the nail (N) in the muzzle unit 3.

Step 75: The control panel subunit 65 de-energizes the nail-striking solenoid valve 55, releasing the nail-striking valve rod 551, and the impact member 54 is then biased by the retrieving subunit 56 to return to the nail-striking starting position.

Referring to FIGS. 3, 6, 9 and 11, Step 90 further includes the following steps.

Step 91: The control panel subunit 65 energizes the nail-feeding solenoid valve 43 to start the nail-feeding operation. During this time, the nail-feeding valve rod 431 is driven to move the pushing member 42 toward the nail-engaging position.

Step 92: The control panel subunit 65 de-energizes the nail-feeding solenoid valve 43, and the nail-feeding valve rod 431 is then biased by the return spring 45 to move the pushing member 42 toward the nail-releasing position.

Figure 9:
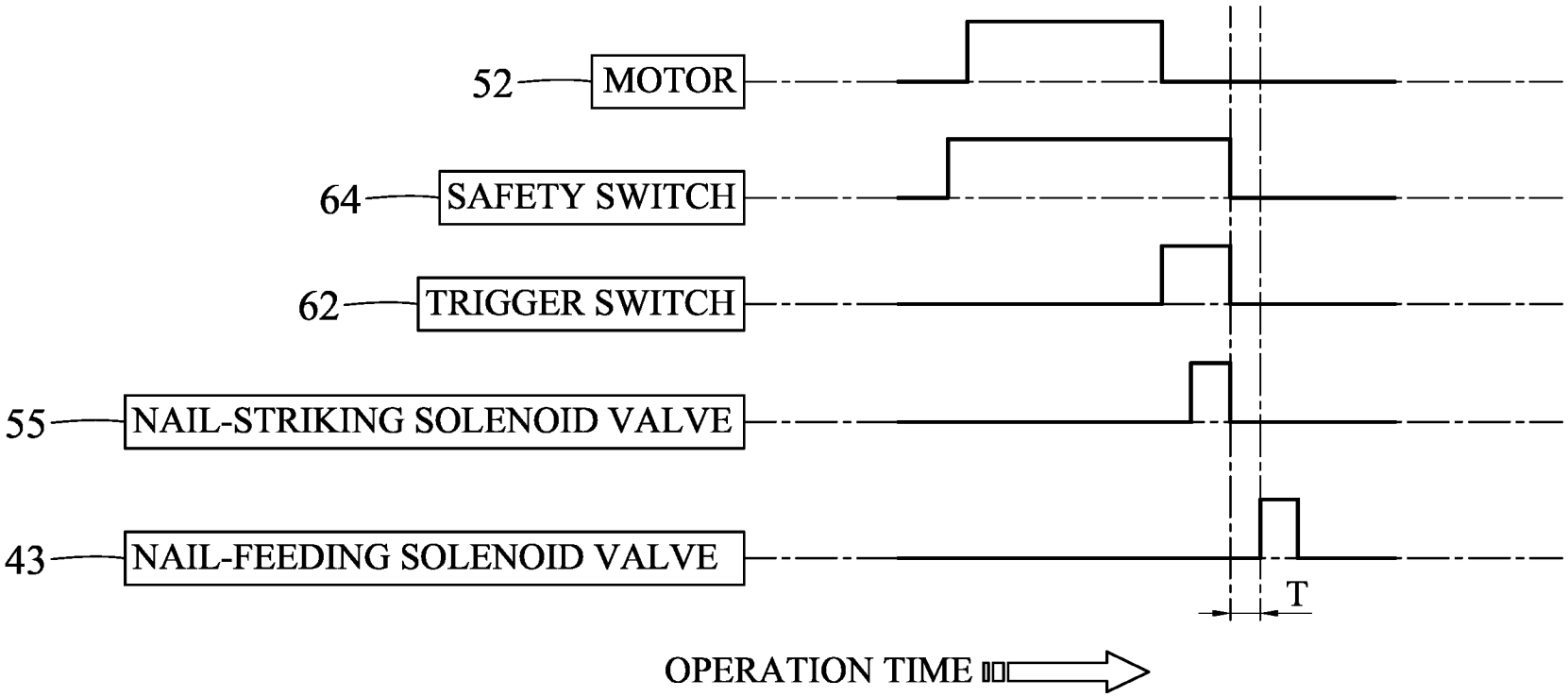
FIG. 9 is a schematic diagram illustrating a detailed operational sequence of the embodiment for a single-firing mode.

It should be noted that, as shown in FIG. 9, the control panel subunit 65 of the control unit 6 is configured such that the energization of the nail-feeding solenoid valve 43 always occurs after the de-energization of the nail-striking solenoid valve 55 during the operations.

It should also be noted that, in Step 70, after the nail-striking operation is completed and the control panel subunit 65 de-energizes the nail-striking solenoid valve 55, the swing arm 53 moves away from the flywheel 51. As a result, the impact member 54 is separated from the flywheel 51, and is thus allowed to be retrieved by the retrieving subunit 56 to return to the nail-striking starting position.

The above-mentioned retrieving process has been disclosed in the prior art of the field. Since it is not the main feature of the present disclosure, and should be appreciated by those familiar with the art based on the description above, further details thereof will not be provided hereinafter.

Figure 10:
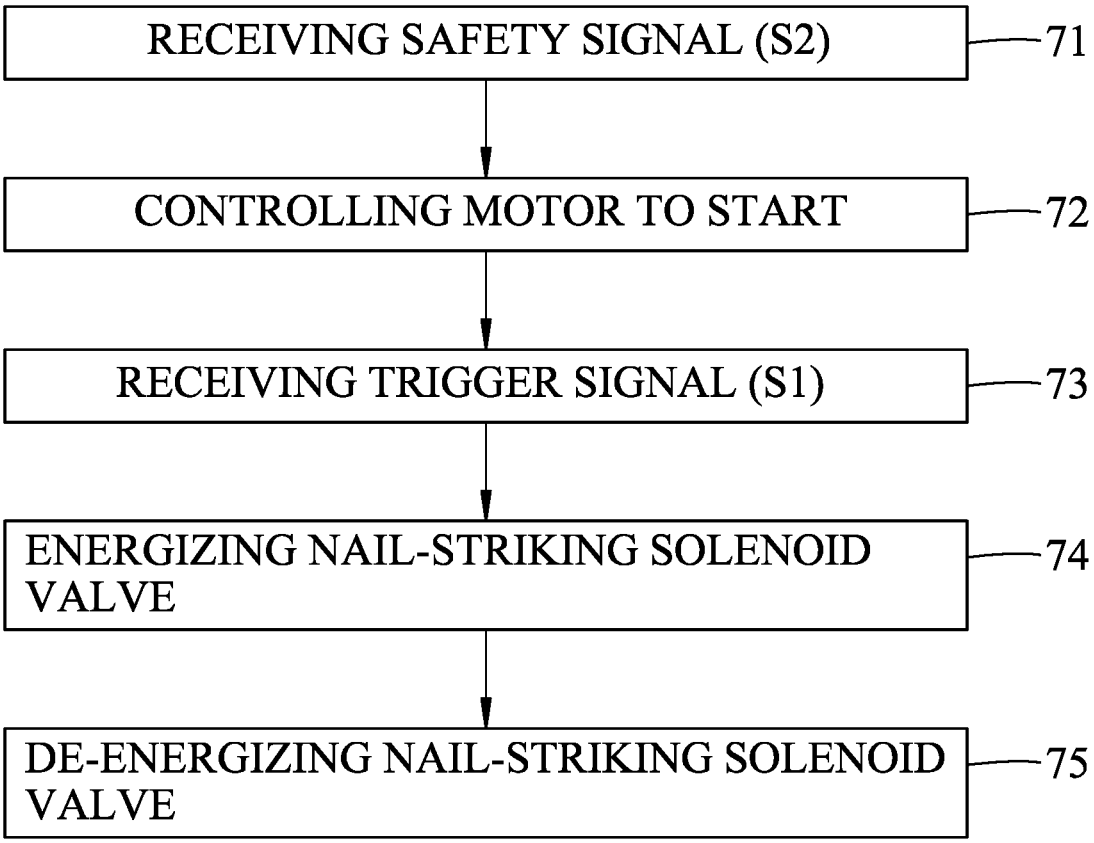
FIG. 10 is a flowchart illustrating a nail-striking operation of the embodiment.
Figure 11:
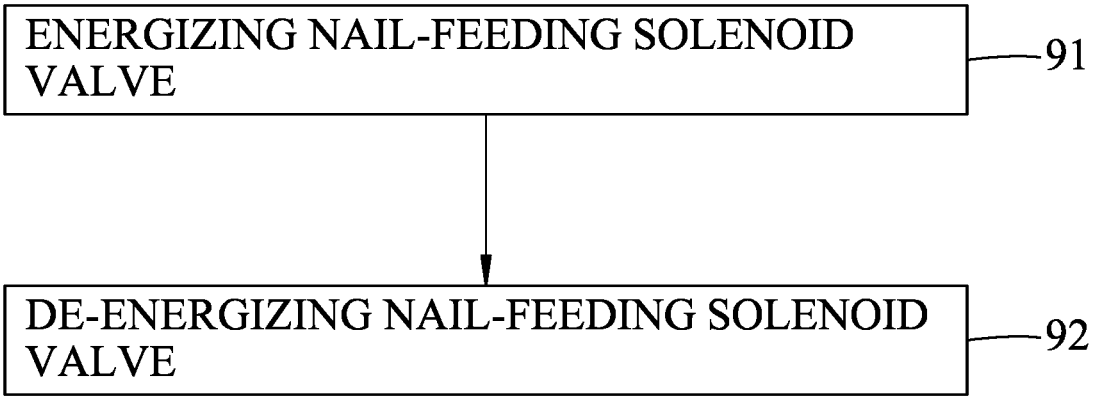
FIG. 11 is a flowchart illustrating a nail-feeding operation of the embodiment.
Figure 12:
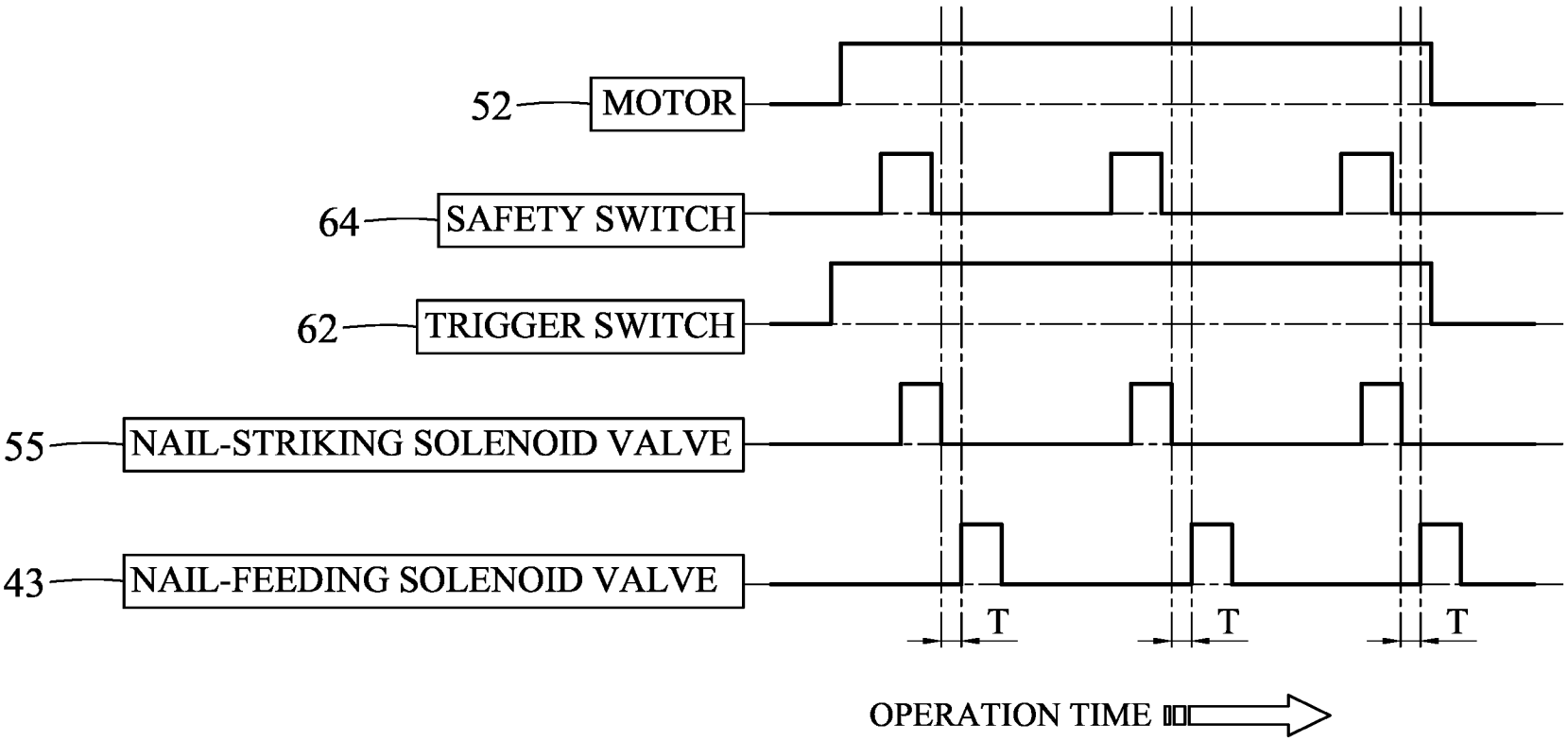
FIG. 12 is a schematic diagram illustrating a detailed operational sequence of the embodiment for a continuous-firing mode.

It should be noted that, the nail gun of the present embodiment is not limited to the single-firing mode as shown in FIGS. 9 and 10. In variations of the embodiment, as shown in FIGS. 3 and 12, if the trigger subunit 61 is operated before the safety subunit 63 is operated, the nail gun enters a continuous-firing mode, in which the safety subunit 63 can be operated repeatedly to transmit the safety signal (S2) repeatedly. In this case, the control panel subunit 65 actuates the motor 52 after receiving the trigger signal (S1). If the control panel subunit 65 continues to detect the trigger signal (S1) (i.e., the trigger subunit 61 remains in operated state), each time it receives the safety signal (S2) (i.e., each time the safety subunit 63 is operated), it energizes the nail-striking solenoid valve 55, and drives the impact member 54 to strike a corresponding one of the nails (N) out of the muzzle unit 3.

Similar to the single-firing mode, the energization of the nail-feeding solenoid valve 43 always occurs after the energization of the nail-striking solenoid valve 55 in the continuous-firing mode. Since further details thereof should be appreciated by those familiar with the art based on the description above, they will not be provided hereinafter.

It should also be noted that, the nail gun of the present disclosure is not limited to the embodiment shown in FIGS. 2 to 12. In other embodiments, the nail gun may be configured as a pneumatic nail gun disclosed in U.S. Pat. No. 8,387,718B2. In this case, the nail-striking operation and the nail-feeding operation can also be separated by the delay time period (T) via configurations of the control system and solenoid disclosed therein.

In sum, benefits of the present embodiment according to the disclosure are as follows.

By virtue of the design of adding the delay time period (T), and the sequence in which the nail-striking solenoid valve 55 and the nail-feeding solenoid valve 43 are energized, the nail-striking operation and the nail-feeding operation are prevented from interfering with each other, which ensures the efficiency of the operations, reduces the risk of malfunction, and increases the service life of the nail gun.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A method for feeding nails in a nail gun, the nail gun including a gun body, a muzzle unit that is connected to the gun body, a nail-feeding unit that is connected to the muzzle unit, that is used for loading the nails, and that includes a pushing member configured to perform a nail-feeding operation which feeds one of the nails to the muzzle unit, and a nail-feeding solenoid valve configured to drive the pushing member to perform the nail-feeding operation when being electrically energized, a nail-striking unit that is mounted in the gun body, that is configured to perform a nail-striking operation which strikes the one of the nails out of the muzzle unit, and that includes a nail-striking solenoid valve configured to drive the nail-striking unit to perform the nail-striking operation when being electrically energized, and a control unit that is mounted in the gun body, and that is electrically connected to the nail-feeding solenoid valve and the nail-striking solenoid valve for controlling the nail-feeding unit and the nail-striking unit to implement said method, said method comprising the following steps:

(a) energizing the nail-striking solenoid valve of the nail-striking unit to perform the nail-striking operation on the one of the nails;

(b) de-energizing the nail-striking solenoid valve of the nail-striking unit, and simultaneously starting to count a predetermined delay time period in idle; and (c) upon elapse of said delay time period, energizing the nail-feeding solenoid valve of the nail-feeding unit to drive the pushing member to perform the nail-feeding operation on another one of the nails.

2. The method for feeding nails in a nail gun as claimed in claim 1, wherein said delay time period ranges from 0.001 second to 1 second.

3. A nail gun comprising:

a gun body;

a muzzle unit that is connected to said gun body, and that has a muzzle mouth;

a nail-feeding unit that is connected to said muzzle unit, that is adapted for loading a plurality of nails, and that includes a pushing member configured to perform a nail-feeding operation which feeds one of the nails to said muzzle unit, and in which said pushing member is movable relative to said muzzle unit between a nail-engaging position that is distal from said muzzle unit, and a nail-releasing position that is proximate to said muzzle unit, and a nail-feeding solenoid valve configured to drive said pushing member to perform the nail-feeding operation when being electrically energized;

a nail-striking unit that is mounted in said gun body, and that includes an impact member configured to perform a nail-striking operation which strikes the one of the nails out of said muzzle mouth of said muzzle unit, and in which said impact member is movable relative to said muzzle mouth from a nail-striking starting position that is distal from said muzzle mouth, to a nail-striking finishing position that is proximate to said muzzle mouth, and a nail-striking solenoid valve configured to drive said impact member to perform the nail-striking operation when being electrically energized; and a control unit that is mounted in said gun body, and that is electrically connected to said nail-feeding solenoid valve and said nail-striking solenoid valve for controlling said nail-feeding unit and said nail-striking unit, such that the nail-striking operation and the nail-feeding operation are separated by a predetermined delay time period;

wherein said control unit is configured for:

energizing said nail-striking solenoid valve of the nail-striking unit to perform the nail-striking operation;

de-energizing said nail-striking solenoid valve of the nail-striking unit, and simultaneously starting to count said delay time period in idle; and upon elapse of said delay time period, energizing said nail-feeding solenoid valve of the nail-feeding unit to perform the nail-feeding operation.

4. The nail gun as claimed in claim 3, wherein said nail-feeding unit further includes a magazine that is connected to said muzzle unit, and that is adapted for loading the nails arranged in a row, said nail-feeding solenoid valve of said nail-feeding unit having a telescopic nail-feeding valve rod connected to said pushing member and changeable in length for driving movement of said pushing member.

5. The nail gun as claimed in claim 4, wherein said pushing member is pivotable relative to said nail-feeding valve rod of said nail-feeding solenoid valve, said nail-feeding unit further including a torsion spring that is disposed between and abutting against said nail-feeding solenoid valve and said pushing member, and that is configured to bias said pushing member to pivot toward the nails.

6. The nail gun as claimed in claim 4, wherein:

said nail-feeding unit further includes a return spring that is mounted to said nail-feeding solenoid valve, and that is configured to bias said nail-feeding valve rod to move toward said muzzle unit to thereby move said pushing member toward the nail-feeding finishing position when said nail-feeding solenoid valve is de-energized; and when said nail-feeding solenoid valve is energized, an electromagnetic force generated thereby drives said nail-feeding valve rod to move away from said muzzle unit to thereby move said pushing member toward the nail-feeding starting position.

7. The nail gun as claimed in claim 6, wherein:

said nail-striking unit further includes a flywheel that is rotatably mounted to said gun body, a motor that drives rotation of said flywheel by electric power, and a swing arm that is pivotally mounted to said gun body, that is pivotable to become proximate to or distal from said flywheel, said impact member being slidably mounted to said swing arm and being disposed between said swing arm and said flywheel, said nail-striking solenoid valve having a nail-striking valve rod movable to contact said swing arm so as to drive pivotal movement of said swing arm;

when said nail-striking solenoid valve is energized, an electromagnetic force generated moves said nail-striking valve rod in said gun body so as to move said swing arm and said impact member toward said flywheel;

when said impact member contacts said flywheel, said impact member is driven by the rotation of said flywheel to move from the nail-striking starting position toward the nail-striking finishing position; and said control unit is configured to energize said nail-feeding solenoid valve after de-energizing said nail-striking solenoid valve during an operation.

8. The nail gun as claimed in claim 7, wherein said control unit includes:

a trigger subunit that is pivotally mounted to said gun body, and that is manually operable;

a trigger switch that is mounted to said gun body, and that is configured to be activated by pivotal movement of said trigger subunit to transmit a trigger signal;

a safety subunit that is slidably mounted to said muzzle unit, and that is manually operable;

a safety switch that is mounted to said gun body, and that is configured to be activated by sliding movement of said safety subunit to transmit a safety signal; and a control panel subunit that is communicatively connected to said trigger switch, said safety switch, said motor, said nail-feeding solenoid valve and said nail-striking solenoid valve, and that is configured to drive said motor to rotate said flywheel based on one of said trigger signal and said safety signal.

9. The nail gun as claimed in claim 8, wherein:

when rotation of said flywheel reaches a predetermined speed, said control panel subunit energizes said nail-striking solenoid valve for a predetermined nail-striking time period; and upon elapse of the nail-striking time period after said nail-striking solenoid valve is de-energized, said control panel subunit energizes said nail-feeding solenoid valve for a predetermined nail-feeding time period.

10. The nail gun as claimed in claim 7, wherein said nail-striking unit further includes a retrieving subunit that is mounted between said gun body and said impact member, and that is configured to bias said impact member toward the nail-striking starting position.

* * * * *